US005580336A

United States Patent [19]

Coallier

[11] Patent Number: 5,580,336

[45] Date of Patent: Dec. 3, 1996

[54] HAND EXERCISER

[76] Inventor: Serge Coallier, 81b, boul. de Suisse, app. 6, Toulouse, France, 31200

[21] Appl. No.: 437,202

[22] Filed: May 8, 1995

[51] Int. Cl.[6] ..... A63B 23/16; A63B 43/02

[52] U.S. Cl. ..... 482/44; 482/49; 482/148; 601/40; 601/129; 601/131; 273/586

[58] Field of Search ..... 482/44, 47, 49, 482/50, 108, 132, 139, 45, 46, 106, 148; 601/39, 40, 118, 125, 128, 129, 131, 28, 32, 119, 134, 135; 446/122, 487, 489; 273/58 R, 58 BA, 58 C, 58 B; 434/258

[56] References Cited

U.S. PATENT DOCUMENTS

| | | | |
|---|---|---|---|
| 2,011,471 | 8/1935 | Casagrande et al. | 601/128 |
| 2,286,324 | 6/1942 | Wentz | 482/44 |
| 2,691,978 | 10/1954 | Kirby | 601/129 |
| 3,279,462 | 10/1966 | Niquet | 601/118 |
| 3,550,312 | 12/1970 | East | 482/44 |
| 4,374,519 | 2/1983 | Stauft . | |
| 5,375,848 | 12/1994 | Coleman | 273/58 C |

FOREIGN PATENT DOCUMENTS

| | | | |
|---|---|---|---|
| 0005313 | 8/1905 | United Kingdom | 482/50 |

*Primary Examiner*—Richard J. Apley
*Assistant Examiner*—Victor K. Hwang
*Attorney, Agent, or Firm*—Francois Martineau

[57] ABSTRACT

A hand exerciser device for fatigueless muscular exercising of a user's hand, arm and wrist, comprising: a first and a second spherical ball, each sized to fit inside the palm of a user's hand and surfaced for comfortable skin contact. A rigid connector tube interconnects the first and second balls by having its opposite end portions slidingly extending through a bore in the wall of each corresponding ball, wherein free rotational motion of the first and second ball members independently of one another is achieved. The intermediate section of the connector tube forms an accordion pleating, providing limited universal joint capability.

13 Claims, 2 Drawing Sheets

HAND EXERCISER

FIELD OF THE INVENTION

This invention relates to a small exercising device which can be carried in a single hand, for providing muscular exercise of the arm, hand, and wrist, when flexing the fingers.

BACKGROUND OF THE INVENTION

Small dumbbells are often used in enhancing the muscular fitness of a user's arm, without significant muscular fatigue. However, these dumbbells still eventually generate some arm numbness, do not permit articulation of the fingers nor of the whole hand, and still bring some fatigue level after a while.

U.S. Pat. No 3,069,161 issued Dec. 18, 1962 to James MELCHIONA, does disclose a hand exerciser consisting of two balls which are interconnected by a straight connector member. Connector member can be twisted, whereby the balls are partly rotatable relative to one another.

U.S. Pat. No. 4,984,784 issued 15 Jan. 1991 to Arthur BAILEY discloses a hand exerciser consisting of a pair of balls interconnected by a magnet. This magnet allows translational as well as relative rotational motion of the balls.

U.S. Pat. No. 4,577,858 issued 25 Mar. 1986 to Masanobu HIGAMI discloses a fingertip exerciser, consisting of two balls that are interconnected to one another by a quadrangular open frame, wherein the balls can rotate independently of one another orthogonally to the interconnection radial axis of the connector frame.

OBJECTS OF THE INVENTION

The gist of the invention is to provide a hand exerciser which will improve the fingers dexterity and enhance muscular mass of the forearm, arm, wrist and hands, without inducing undue strain or fatigue.

Another object of the hand exerciser is to promote blood circulation to the hand.

A general object of the invention is to provide a hand exerciser that will easily adapt to the user's hand.

Corollary objects of the invention are that this hand exerciser be lightweight, simple in use, and of low manufacturing cost.

An important object of the invention is to improve upon existing hand and fingertip exercisers, by expanding the nature and extent of relative motion of their components.

SUMMARY OF THE INVENTION

Accordingly with the objects of the invention, there is disclosed a hand exerciser device for fatigueless muscular exercising of a user's hand, arm and wrist, said hand exerciser device comprising: (a) a first ball member; (b) a second ball member, each of said first and second ball members sized to fit inside the palm of a user's hand and surfaced for comfortable skin contact; (c) a rigid connector member, having a main body and first and second opposite end portions, said connector member adapted to interconnect said first and second balls at said opposite end portions thereof; (d) mounting means, mounting said connector member first and second end portions to said first and second ball members respectively for free rotational motion of said first and second ball members independently of one another; and (e) relative motion means, cooperating with said connector member for adjustably varying the distance between said first and second ball members.

Preferably, said connector member main body consists of an elongated tubular member, and said relative motion means includes a channel member made into each of said ball members, each of the two said channel members being slidingly engaged by respective said opposite end portions of the tubular member, whereby said ball members move away from or toward one another as said opposite end portions of said connector member slide through said channel members. Said connector member could then include limit means, cooperating with each said channel member, for preventing accidental release of said connector member from said ball members when said ball members are farthest away from one another.

Alternately, or concurrently, said relative motion means could include, or preferably further includes, a universal joint member, mounted intermediately of said rigid connector member main body for enabling both limited translational motion of one said ball member relative to another ball member, and relative movement of said ball members away from or toward one another. There could also be provided second limit means, mounted spacedly from the first mentioned limit means on the connector tubular member and adjacent said universal joint member, for preventing a said ball member from slidingly engaging over said universal joint member.

Profitably, said universal joint member is formed by accordion pleating of the intermediate section of said rigid connector member main body.

Preferably, each said ball member is of generally spherical shape and is formed of a soft material chosen from the group comprising: elastomeric materials, and thermoplastics such as that sold under the trademark "CELLULOID". Also, the peripheral radially outward surface of each said ball member could further carry a plurality of integral small smooth protuberances, said protuberances dynamically generating a soothing massaging effect on the hand skin upon the hand fingers being flexed to rotate the exerciser device inside the hand.

Preferably, each said ball member is hollow, each said tubular member end portion is cylindrical, and each channel member consists of a circular bore made through the wall of a corresponding said ball member, wherein said tubular member end portions slidingly and rotatably extend through and into the hollow of said ball members when said ball members are manually drawn toward one another. It is envisioned that the first mentioned limit means be formed by a pair of annular steps, integrally carried radially outwardly of each of the two opposite ends of said connector tubular members end portions, said annular steps being diametrally larger than said bores of the ball members. It is further envisioned that said second limit means be also formed by a pair of annular steps, integrally carried radially outwardly of each of the two connector tubular members end portions adjacent said connector member intermediate accordion pleating section.

Preferably, both said first and second ball members are of same size and shape, with the diameter of each said ball member being of about 40 millimetres, and the total length of said connector tubular member being of about 75 millimetres.

DETAILED DESCRIPTION OF THE EMBODIMENTS OF THE INVENTION

Figure 1:
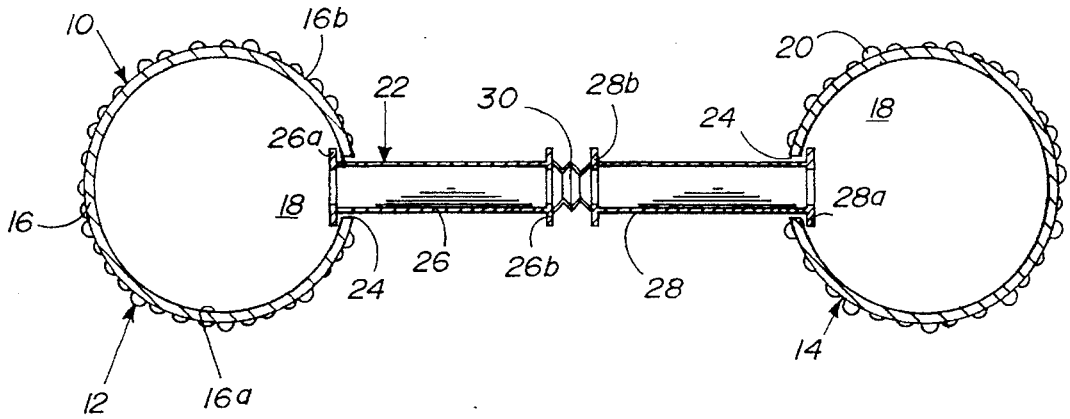
FIG. 1 is a cross-sectional view of the exerciser device according to a preferred embodiment of the invention, taken along line 1—1 of FIG. 2, with the ball members being in their extended condition so as to sequentially suggest with FIG. 2 the relative radial displacement capability of the two ball members relative to one another.

The hand exerciser 10 consists of two ball members 12, 14, interconnected by a connector member 22. Each ball member 12, 14, defines a spherical body 16, having an interior face 16*a* and an exterior face 16*b*, with the interior spherical wall 16*a* circumscribing an inner hollow 18. The diameter of each ball member 12, 14, should be such as to easily fit within the palm of a user's hand; it has been found by the present inventor that best performance is achieved with a ball member diameter of about 40 millimetres. The length of the adjustable length connector member 22 should be such that the whole exerciser assembly 10 be able to substantially fit inside a single open hand; it has been found by the present inventor that best performance is achieved with a length of connector tubular member 22 of about 75 millimetres. Both balls 12, 14, should preferably be identical, both in size and in shape.

Ball members 12, 14, should be made from a soft, resilient yet sturdy material, such as CELLULOID (a registered trademark) or an elastomeric material, or the like; the preferred material being a soft rubber forming a compressible (i.e. collapsible) resilient ball similar to the one used by sportsmen in the "squash" racket game. However, fully rigid structure balls, such as for example ping-pong type balls or plastic golf practise balls, are not excluded from the scope of the present invention. Preferably, the exterior wall 16*b* of each ball member 12, 14, includes protuberances 20, knurling, serrate elements, ribs, or the like smooth but irregular, radially-outwardly projecting surface patterns capable of providing a soothing massaging effect on the palm of the user's hand when the balls 12, 14, are rotated inside the hand. Each ball 12, 14, includes a through bore 24 extending through an arcuate section of spherical body 16, wherein hollow 18 opens to the outside through this bore 24.

The connector member 22 forms an elongated tube made up of three distinct sections: first and second opposite cylindrical section 26, 28, and an intermediate accordion-like section 30 integrally joining the two cylindrical sections 26 and 28. Preferably, sections 26, 28, 30, are hollow, to keep weight of the exerciser to a minimum. Each cylindrical section 26, 28, has at both opposite ends thereof diametrally enlarged radially outwardly depending rings 26*a*, 26*b*, and 28*a*, 28*b*, respectively, integrally thereof. The diameter of bores 24 is accordingly intermediate that of cylinders 26, 28, and of rings 26*a*, 26*b*, 28*a*, 28*b*. Cylinder 26 slidingly engages bore 24 of ball 12, with its outer ring 26*a* being located inside hollow 18 of ball 12 while its inner ring 26*b* is located outside of ball 12. Similarly, cylinder 28 slidingly engages bore 24 of ball 14, with its outer ring 28*a* being located inside hollow 18 of ball 14 while its inner ring 28*b* is located outside of ball 14.

Figure 2:
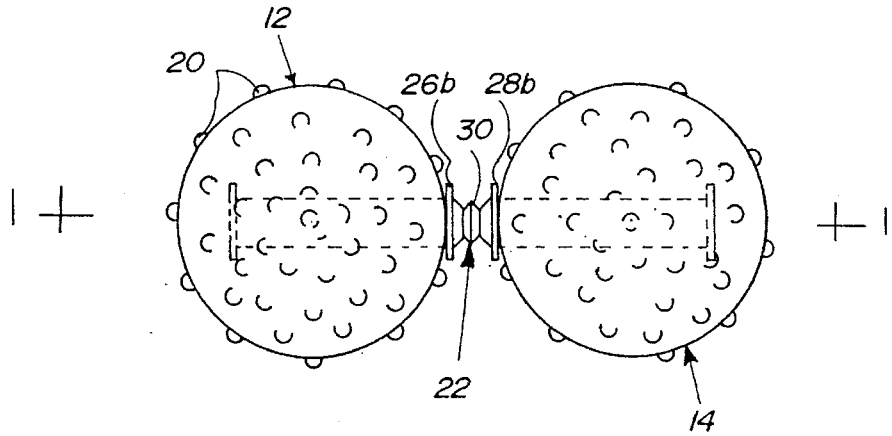
FIG. 2 is a plan view of the combined pair of ball members and tubular arm interconnecting same in retracted condition and forming the exerciser of the present invention.
Figure 3:
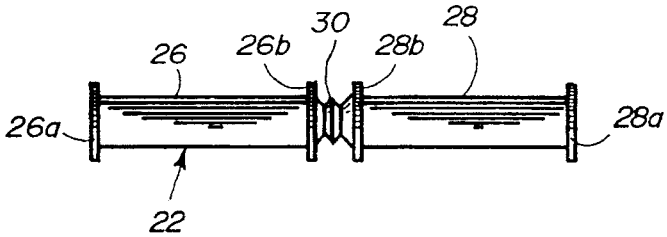
FIG. 3 is a plan view of the tubular arm that interconnects the pair of spherical ball members according to the invention.

Accordingly, and as suggested sequentially by FIGS. 1 and 2 of the drawings, balls 12, 14, are movable away from one another by radial sliding motion over respective cylinder sections 26, 28, to an extended limit condition (FIG. 1) where enlarged outer discoid seats 26*a*, 28*a* abut against the radially inward wall 16*a* of the two respective balls 12, 14, from a retracted limit condition (FIG. 2), where enlarged inner discoid seats 26*b*, 28*b*, abut against the radially outward wall 16*b* of the two respective balls 12, 14. Preferably, outer annular seats 26*a*, 28*b*, are slightly concave (not shown) from end view, to conformingly fit against the arcuate concave edge portion of radially inward wall 16*a* adjacent bore 24 in the extended condition of the ball members 12, 14; while inner annular seats 26*b*, 28*b*, are slightly convex from a perspective at intermediate connector section 30, to conformingly fit to the exterior convex edge portion of radially outward wall 16*b* adjacent bore 24 in the retracted condition of the ball members 12, 14.

Figure 4:
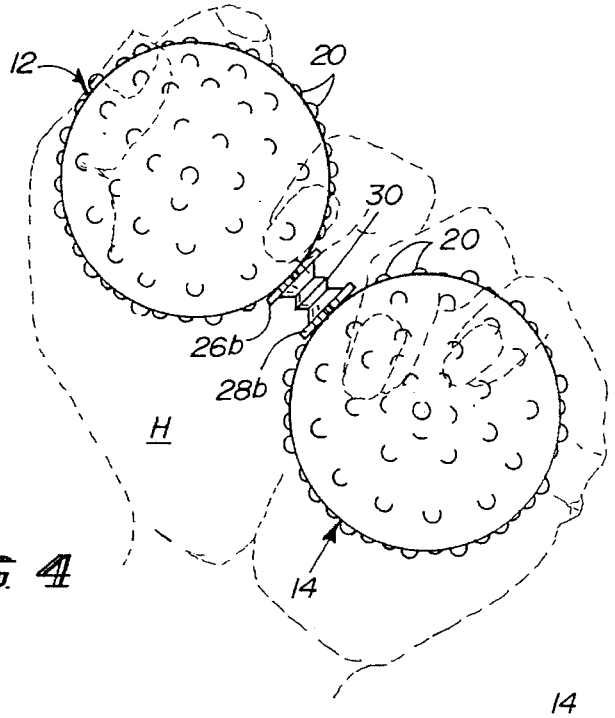
FIG. 4 is an isometric view of the preferred embodiment of hand exerciser, suggesting the translational capability of the two ball members when manipulated by the user's fingers (in phantom lines)

FIG. 4 suggests how each ball 12 or 14 can be freely rotated independently or in concurrent fashion relative to the other ball, axially around connector tube 22, with the hand exerciser being in the retracted condition. This can be done by finger flexing, i.e. by successive swinging motion of the thumb and of the other fingers of the hand H against the ball, with one ball 12 or 14 being alternately placed on the palm of the hand.

Moreover, rotation of the whole exerciser unit 10 can also be performed manually.

Figure 5:
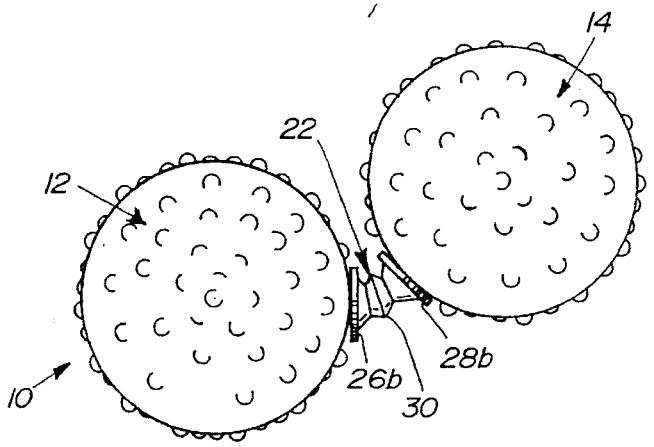
FIG. 5 is a plan view of the exerciser similar to FIG. 2, but suggesting how the accordion pleat joint of the tubular connector can provide relative tilt adjustment of the two ball members.
Figure 6:
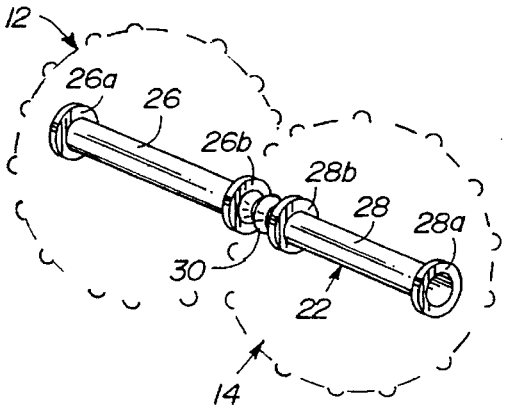
FIG. 6 is an isometric, partly schematic view of the retracted hand exerciser, showing the tubular connector in perspective view.

FIG. 5 is a view of the hand exerciser in retracted condition, but showing how the connector member 22 can be tilted at its intermediate section 30. Tilting action is enabled by virtue of the fact that the pleats formed in tubular body 22 about accordion section 30 weaken the otherwise rigid body 22, so that lateral tilt flexibility is achieved. Accordion section 30 thus provides universal joint means, that enable limited tilt or translational relative ball motion capability in substantially all directions. During such translational motion of one ball 12 or 14 relative to the other, there is also a vectorial movement of the balls toward one another concurrently with the translational motion thereof.

In use, the exerciser unit 10 is put into the palm of a user's hand, and contained by the fingers of that same hand. Exerciser rotation is achieved by flexing of the successive fingers, starting with the thumb, the forefinger, the second finger, the ring-finger, and finally the small finger. The thumb rearwardly tilts the first ball 12, and by the follow up of the forefinger and other successive fingers of this hand, the connector arm 22 brings forwardly therewith the second ball 14, thus triggering a rotation of the whole exerciser unit 10 within the hand orbit. Thanks to the capability of each ball 12 and 14 to freely rotate independently of one another and axially around tube 22, fatigue of the fingers is reduced to the minimum. The adjustable distance between the two balls 12 and 14 enabled by connector 22 allows both balls to move freely towards or away from one another in a natural fashion, while ergonomically adapting to the size and shape of the particular user's hand. Moreover, the accordion section 30 enables the exerciser unit 10 to desirably cave in during rotation thereof in the hand, yieldingly to temporary torsional loads induced on one ball 12 or 14 transversely to the axis of connector 22, depending upon the angular relationship of the hand palm relative to the fingers.

A pair of such hand exercisers 10 can easily be carried by a user, one for each hand, while walking to the office, strolling, jogging, or simply while relaxing on the sofa. Indeed, it is preferred that the hand exercisers 10 be used in pairs, to balance the swinging motion thereof in each hand. Right-handed as well as left-handed persons will benefit equally from this exerciser. Furthermore, use of this hand exerciser device is not limited to athletes, but can extend to persons of all ages and physical conditions, not excluding elderly persons or even handicaped persons.

I claim:

1. A hand exerciser device for use inside a single hand of a person for massaging that person's hand palm, comprising:

first and second hollow ball members, adapted to fit inside the palm of the user's hand each ball member having a single radial bore;

an elongated connector member, including first and second rigid tubular sections and a universal joint member mounted intermediate said first and second tubular sections integrally thereof; said tubular sections each defining:

i) a main body, extending freely through and diametrally sized complementarily to the radial bore of a corresponding one of said ball members;

ii) an inner end, integral to said joint member, and iii) an opposite outer end, located inside a corresponding one of said ball members;

wherein said main body of said first tubular section is slidingly engaged through said first ball member radial bore for radial displacement through the hollow of said first ball member between a fully retracted limit position, in which the latter main body is fully engaged into the first ball hollow, and a fully extended limit position, in which the latter main body is fully released from the first ball hollow but with said first tubular section outer end remaining inside the first ball hollow;

and said main body of said second tubular section is slidingly engaged through said second ball member radial bore for radial displacement through the hollow of said second ball member between a fully retracted limit position, in which the latter main body is fully engaged into the second ball hollow, and a fully extended limit position, in which the latter main body is fully released from the second ball hollow but with said second tubular section outer end remaining inside the second ball hollow;

said ball members being rotatable relative to one another axially around said connector member; wherein relative ball members rotation, and tubular sections extension\retraction from\into the ball members, can be performed by the user's fingers of the same single hand.

2. A hand exerciser device as in claim 1, wherein each said tubular section carries an enlarged flange member at its said outer end, these flange members being diametrally larger than the corresponding said radial bores of the ball members to prevent accidental disengagement of the corresponding said first and second tubular sections from the corresponding bores of said first and second ball members respectively.

3. A hand exerciser device as in claim 1, wherein each said ball member includes a plurality of radially outturned protuberances, for providing enhanced massaging effect on the palm of the user's hand.

4. A hand exerciser device as in claim 1, wherein each said tubular section further carries an additional enlarged flange member at its said inner end, each of these additional flange members being diametrally larger than the corresponding said radial bore to prevent accidental engagement of said universal joint member into the hollow of either of said ball members.

5. A hand exerciser device as defined in claim 1, wherein said universal joint member is formed by accordion pleating of a tubular section of said connector member integrally mounted to said first and second tubular sections.

6. A hand exerciser device for fatigueless muscular exercising of a user's hand, arm and wrist, said hand exerciser device comprising:

(a) a first ball member;

(b) a second ball member, each of said first and second ball members adapted to fit inside the palm of a user's hand;

(c) a rigid connector member, having a main body with first and second opposite end portions, said connector member adapted to interconnect said first and second ball members at said opposite end portions thereof;

(d) mounting means, mounting said connector member first and second end portions to said first and second ball members respectively for free rotational motion of said first and second ball members independently of one another; and (e) relative motion means, cooperating with said connector member for adjustably varying the distance between said first and second ball members;

wherein said connector member main body consists of an elongated tubular member, and said relative motion means includes a channel member made radially through each of said ball members, each of the two said channel members being slidingly engaged by respective said opposite end portions of the tubular member, whereby said ball members move away from or toward one another as said opposite end portions of said connector member slide through said channel members;

said connector member including first limit means, cooperating with each said channel member, for preventing accidental release of said connector member from said ball members when said ball members are farthest away from one another;

said relative motions means including a universal joint member, mounted intermediately of said connector member main body for enabling both limited translational motion of one said ball member relative to another ball member, and relative movement of said ball members away from or toward one another;

wherein said universal joint member is formed by the accordion pleating of an intermediate section of said connector member main body connector member further includes second limit means spacedly mounted from the first limit means and adjacent said universal joint member for preventing each said ball member from slidingly engaging over said universal joint member.

7. A hand exerciser device as defined in claim 1, wherein said connector member is of generally spherical shape and is formed of a soft material chosen from the group comprising: elastomeric materials, and thermoplastics.

8. A hand exerciser device as defined in claim 7, wherein the peripheral radially outward surface of each said ball member carries a plurality of integral small booth protuberances, said protuberances dynamically generating a soothing massaging effect on the skin of fingers being flexed to rotate the exerciser device inside the hand.

9. A hand exerciser device as defined in claim 6, wherein each said ball member is hollow, each said tubular member portion is cylindrical, and each channel member consists of a circular bore made through the wall of a corresponding said ball member, wherein said tubular member end portions slidingly and rotatably extend through and into the hollow of said ball members when said ball members are manually drawn toward one another.

10. A hand exerciser device as defined in claim 6, wherein each said ball member is hollow, each said tubular member end portion is cylindrical; and each channel member consists of a circular bore, made radially through the wall of a corresponding said ball member and sized to be diametrally larger than a corresponding said connector tubular member end portion; wherein said tubular member end portions slidingly and rotatably extend through and into the hollow of the corresponding said ball members when said ball members are manually drawn toward one another.

11. A hand exerciser device as defined in claim 10, wherein said first limit means is formed by a pair of annular steps, integrally carried radially outwardly of each of the two opposite ends of said connector tubular members end portions, said annular steps being diametrally larger than said radial bores of the ball members.

12. A hand exerciser device as defined in claim 11, wherein said second limit means is formed by a pair of additional annular steps, integrally carried radially outwardly of each of the two connector tubular members end portions adjacent said accordion pleating.

13. A hand exerciser device as defined in claim 12, wherein both said first and second ball members are of same size and shape, with the diameter of each said ball member being about 40 millimetres, and the total length of said connector tubular member being of about 75 millimetres.

* * * * *